United States Patent [19]

Tucker

[11] 4,061,244

[45] Dec. 6, 1977

[54] COMBINATION CONTAINER WITH REMOVABLE CLOSURE

[76] Inventor: John A. Tucker, 14745 Erwin St., Van Nuys, Calif. 91411

[21] Appl. No.: 743,330

[22] Filed: Nov. 19, 1976

[51] Int. Cl.[2] ..... B65D 41/10

[52] U.S. Cl. ..... 220/310; 215/325

[58] Field of Search ..... 220/260, 265, 306, 308–310, 220/212, 359; 215/100.5, 324, 325

[56] References Cited

U.S. PATENT DOCUMENTS

| | | | |
|---|---|---|---|
| 3,204,813 | 9/1965 | McCuskey et al. | 220/308 |
| 3,598,271 | 8/1971 | Holley | 215/100.5 X |

*Primary Examiner*—George T. Hall

[57] ABSTRACT

A food and beverage container characterized by its sealed closure subsequently removable intact without the aid of an opener and without severage into extraneous trash, there being a container body useful as a drinking vessel and an interlocked closure therefor useful as a coaster, and all of which are conducive to consumer retention as useful items made of material that can be recycled.

4 Claims, 10 Drawing Figures

COMBINATION CONTAINER WITH REMOVABLE CLOSURE

Reference is made to Disclosure Document No. 036,533 filed in the United States Patent Office on Nov. 4, 1976 and entitled "COMBINATION CONTAINER, DRINKING VESSEL AND SAUCER".

BACKGROUND

This invention relates particularly to beverage containers made of material that can be recycled, particularly aluminum cans. The top of such cans have been permanently installed in the usual prior art process of filling the cans with fluid content, said tops having lines of weakening establishing removable portions that are discarded after tearing the same out of integral association with the can top. As a result, there has been a profusion of litter in the form of sharp metallic closures which are abandoned by the beverage consumer and which contaminate the environment. Although the larger volume of discarded metal container bodies are easily retrieved for recycling, the smaller and more dangerous closures are elusive with no economic means of salvage. Therefore, it is an object of this invention to provide a container and closure concept that is conducive to economic salvage and recycling utilizing extruded and/or pressed aluminum or the like as the basic material.

Beverage cans have been opened by the consumer with the use of an implement, either in the form of an opener tool or by lever means applied to removable tear-out portions such as "pull-tabs". In any case, extra implementation has been accepted as necessary, and in the case of "pull-tabs" there is the discard problem of sharp and dangerous trash. There is also the danger of sharp openings in the container lid. It is a general object of the present invention to provide the consumer with a container closure that is removable without added implementation and without producing dangerous trash. A feature of this invention is that both the can body and closure remain intact as sizeable utilitarian objects, the body to be used as a drinking flask and the closure to be used as a coaster or tray.

Beverages are merchandised in container cans comprised of cylinders formed by rolling sheet into tubes with disc-shaped ends applied and sealed for hermetic containment; also cans comprised of extruded cylinders pressed from billets forming the container that is filled and to which a disc-shaped top closure is applied with a perimeter seal. It is the latter type beverage container with which the present invention is particularly concerned, it being an object to provide a removable closure disc for a container cylinder, all of which can be made of malleable material in a form conducive to be retained for use and to be recycled.

Prior art container lids have been attached to the container bodies by permanent bead structures rolled by means of a series of forming operations inseperably locking the cylinder and lid together at a "bead". This accepted procedure is to be replaced in the present invention by a releasable rim that is seperably crimped over a perimeter rib or flange on the container body. With the present invention, the state of the art processes of container manufacture are taken into consideration, so that existent canning machinery is to be used with the modification of the body flange and closure dies. For example, the previous start of a flange at the rim of the container is completed into a finished preformed flange for the subsequent interlocked reception of the rim of the lid. And, the previous unfinished lid perimeter is preformed with a snap-on rim adapted to subsequent crimping and to locking engagement with said preformed flange, subject to release from the container body by means of upward manipulation applied to its characteristic depending skirt.

SUMMARY OF INVENTION

The container-closure combination herein disclosed comprises a base A, a body B and a closure C. The body is a cylinder closed at its bottom end by the base of disc-shape. And, the closure is removably interlocked in sealed engagement with the otherwise open top of said body. The body B is provided with a perimeter flange to which the closure C is sealed, as by means of a snap-on and crimped interlock of the closure rim with said body flange. Removability is facilitated by a depending skirt acting as a lever subject to manipulation that distorts the closure rim and releases the same from the body flange. Both container body and closure retain their initial configuration useful as a drinking vessel and coaster or tray respectively.

DRAWINGS

The various objects and features of this invention will be fully understood from the following detailed description of the typical preferred forms and applications thereof, throughout which description reference is made to the accompanying drawings, in which.

Figure 1:
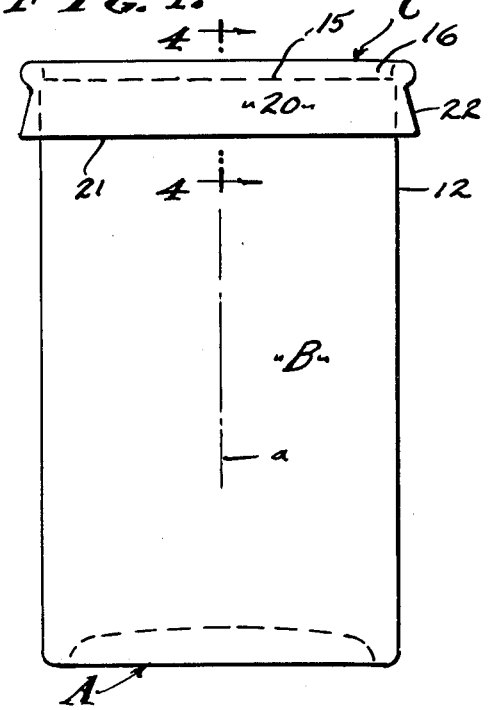
FIG. 1 is a side elevation of the container and closure in the sealed condition.
Figure 2:
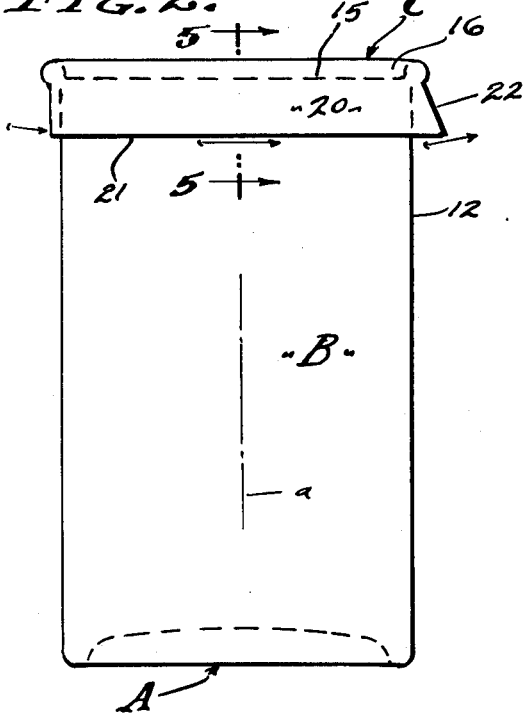
FIG. 2 is a view similar to FIG. 1 showing the closure in the process of being released.
Figure 4:
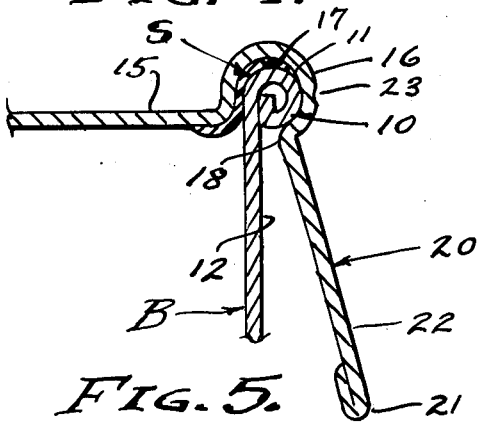
Figure 5:
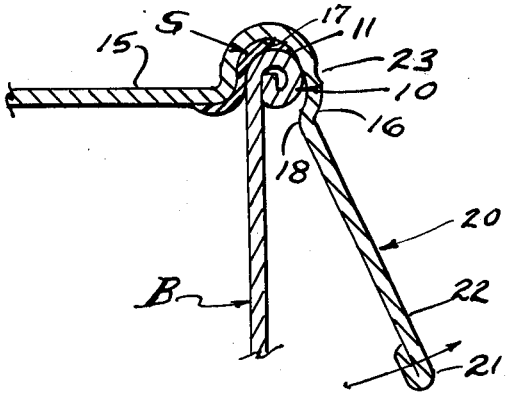

FIGS. 4 and 5 are enlarged sectional views taken as indicated by lines 4—4 and 5—5 on FIGS. 1 and 2 respectively.

Figure 6:
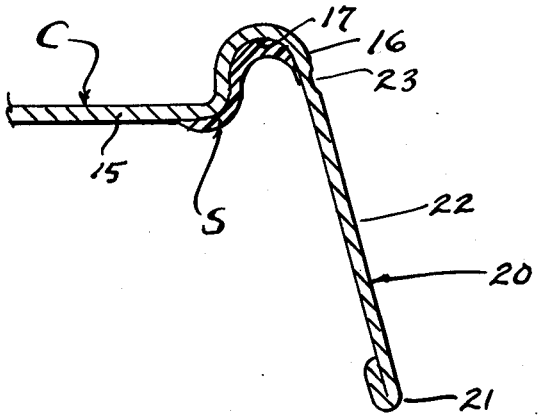

FIG. 6 is an enlarged sectional view of the basic closure rim configuration.

Figure 7:
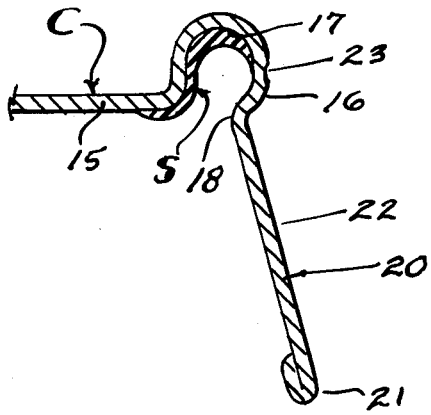
Figure 8:
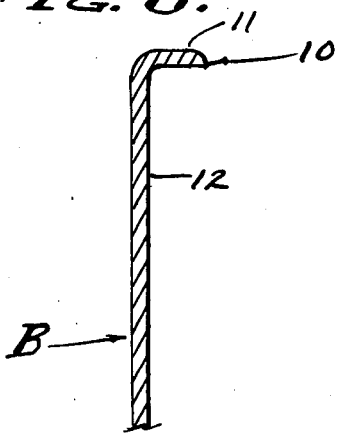
Figure 9:
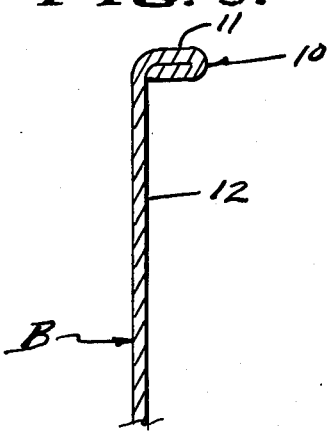
Figure 10:
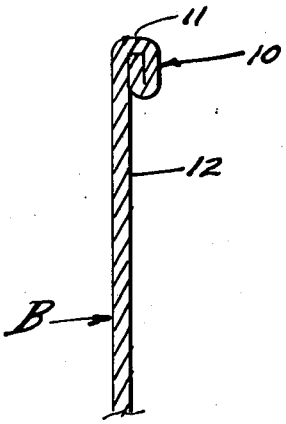

FIG. 7 is a view similar to FIG. 6 showing a snap-on closure rim configuration. And, FIGS. 8, 9, and 10 are enlarged fragmentary views of the container lip, showing three flange formations therefor.

PREFERRED EMBODIMENT

Referring now to the drawings, the base A and body B are integrally formed as by means of impact extrusion from a billet (not shown) of aluminum or the like. Characteristically, the base A is of disc-shape disposed in a plane normal to the container axis *a*, and the body B is of cylinder-shape concentric with said axis. The container is elongated and adapted to set upright upon its base, free standing with an open upper periphery. In accordance with this invention, the said upper periphery of the body B is of thin-walled cross section with an outwardly turned flange 10 having an upwardly disposed surface 11 in a plane normal to the cylinder axis *a*. As shown, the flange 10 can vary in configuration from a single wall to multi walls, and preferably the latter rolled or flattened and disposed either flat against the outer wall 12 of the body or radially therefrom (see FIGS. 8 - 10). The material of the base and body A–B is malleable and adapted to the several formations shown, presenting a permanent and durable flange or bead and a seal surface 11 for the removable closure C and for drinking therefrom as well.

Figure 3:
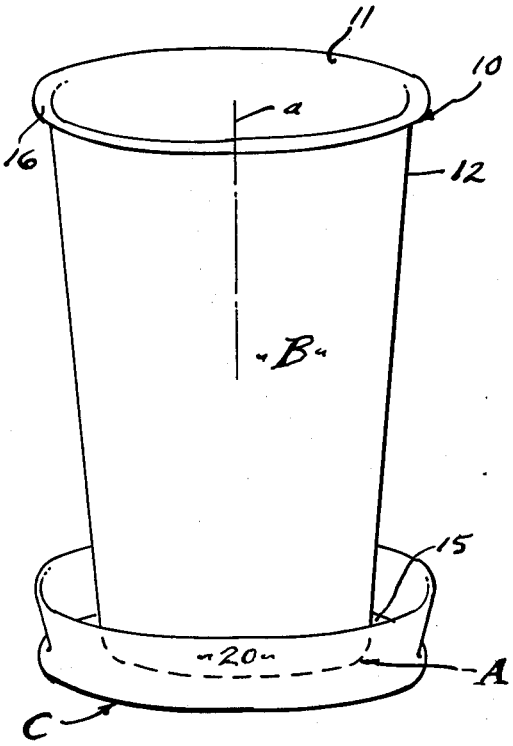
FIG. 3 is a perspective view illustrating the use of the container and closure-coaster.

The drinking vessel and closure-coaster concept is best illustrated in FIG. 3 wherein the container body B is flared so as to have a larger diameter mouth than base A, and so as to conveniently rest within the closure-coaster C with clearance. A discriminate amount of upward taper is applied to the body B as by restriking the same to the form shown while trimming the extruded body and simultaneously forming the above described flange or bead 10. In practice, the body B can be flared to an included angle of about 8° to 10°.

In accordance with this invention I have provided the closure C cooperatively combined with the above described container base and body A–B. The closure C is characteristically of disc-shape comprised of an imperforate planar wall 15 to be disposed in a plane normal to the axis *a* and engaged flat with the flange or bead surface 11. The periphery of the wall 15 is provided with a downwardly turned rim 16 conforming to the outer contour of the flange or bead 10, establishing a circumferentially continuous face 17 of concaved form to engageably oppose the flange or bead surface 11. In practice, the rim 16 is fundamentally of right cylinder form as shown in FIG. 6 and precrimped as shown in FIG. 7 or crimped in the canning process to interlock with the flange or bead 10 as shown in FIG. 4. That is, the rim 16 can be partially crimped with an inwardly turned ridge 18 (see FIG. 7) to underlie the flange or bead 10 for snap-on installation, and subsequently fully crimped as circumstances require.

The container and closure therefor thus far described are to be interlocked in sealed engagement one with the other, and to this end I provide a seal S at the joinder of the wall 15 and rim 16. The seal S is a circumferentially continuous deposit of plastic substance or the like, in a layer to be pressed against the surface 11 for sealed engagement, the configuration of the rim 16 being such that the seal S is compressed upon installation, either when the closure is snapped into working position or when the ridge 18 is crimped for tightness. Thus, the underlying ridge 18 establishes a positive lock, subject to release as next described.

A feature of this invention is the removability of the closure C from the base and body A–B, and to this end there is a skirt 20 depending from the rim 16. The skirt 20 is of flared cylinder form conically divergent from the body wall 12, with a lower edge 21. The skirt 20 overlies the upper marginal portion of the body wall 12 protectively guarding the seal S, and for sanitation, and the edge 21 thereof is accessible a short distance below the rim 16 so as to establish a lever 22 integral with the ridge 18, and so as to be manipulated by finger tip engagement and revolved outward from the container body. In practice, the rim and lever joinder is weakened at 23 so as to establish a fulcrum about which the ridge 18 and lever 22 revolve while distorting the rim 16 and moving the ridge 18 and thereby breaking the interlock. Any position about the closure C can be selected for the lever operation, as a result of which there is a collapsing of the rim 16 and an outward upward deflection of the ridge 18 decreasing in opposite circumferential direction whereby the closure C peals off of the flange or bead 10 to be entirely free of the base-body A–B and intact for use as a coaster or the like. As shown, the skirt edge 21 is turned or doubled so as to provide smoothness, thereby eliminating all sharp corners.

From the foregoing, it will be seen that deliberate outward revolvement of the lever 22 is required for closure removal, and that inward depression thereof is ineffective to break the seal S. The opened container presents a flask or vessel particularly useful for drinking purposes, and the removed closure is cooperatively utilitarian as a coaster or an ashtray, as may be required.

Having described only typical preferred forms and applications of my invention, I do not wish to be limited or restricted to the specific details herein set forth, but wish to reserve to myself any modifications or variations that may appear to those skilled in the art:

I claim:

1. A container and removable interlocked closure of circular form; the container being comprised of a base and an upstanding perimeter wall defining an open topped fluid tight vessel, a circumferential and outwardly disposed peripheral bead in a normal plane at the open top of the container, the closure being comprised of a wall engaged with the bead and a rim circumferentially coextensive with and conforming to said bead and with a ridge continuously underlying the said bead to interlock therewith, seal means disposed between the closure wall and the bead, and a circumferentially continuous conical skirt depending divergently from the said ridge and presenting a manually engageable edge remote from the rim for outward upward deflection deforming the rim and causing it to revolve the ridge outward from the bead in opposite circumferential directions from any point of deflection to thereby release the closure from the container.

2. The container and reusable interlocked closure as set forth in claim 1, wherein the outward peripheral bead of the container is a flattened roll adjacent the perimeter wall of the containeer and having a surface tangent to the opposed underside of the closure wall, and wherein the rim and ridge formed on the cover conform to the said flattened roll configuration.

3. The container and reusable interlocked closure as set forth in claim 1 wherein the skirt is substantially rigid with the said ridge, there being a continuous circumferential weakening at the joinder of the skirt and rim for revolvement of the skirt as a lever when deformed by manual upward and outward lifting.

4. The container and reusable interlocked closure as set forth in claim 1, wherein the outward peripheral bead is a flattened roll adjacent the perimeter wall of the container and having a surface tangent to the opposed underside of the closure wall, wherein the rim and ridge formed on the cover conform to the said flattened roll configuration to which it is thereby interengaged, and wherein the skirt is substantially rigid with the said ridge, there being a continuous circumferential weakening at the joinder of the skirt and rim for revolvement of the skirt as a lever when deformed by manual upward and outward lifting.

* * * * *